US007007586B2

(12) United States Patent
Larroque-Lahitette et al.

(10) Patent No.: US 7,007,586 B2
(45) Date of Patent: Mar. 7, 2006

(54) DEVICE PROVIDING AN ELECTRICAL CONNECTION BETWEEN A WEAPON AND A PIECE OF AMMUNITION

(75) Inventors: Gilles Larroque-Lahitette, Lagor (FR); Pascal Sabourin, Bourges (FR)

(73) Assignee: GIAT Industries, Versailles (FR)

( * ) Notice: Subject to any disclaimer, the term of this patent is extended or adjusted under 35 U.S.C. 154(b) by 0 days.

(21) Appl. No.: 10/732,313

(22) Filed: Dec. 11, 2003

(65) Prior Publication Data

US 2005/0115397 A1 Jun. 2, 2005

(30) Foreign Application Priority Data

Dec. 13, 2002 (FR) ..... 02 15958

(51) Int. Cl.
*F41A 19/05* (2006.01)

(52) U.S. Cl. ..... 89/135; 89/28.05; 89/28.1; 42/84; 42/69.01

(58) Field of Classification Search ..... 89/135, 89/28.05, 28.1; 42/84, 69.01
See application file for complete search history.

(56) References Cited

U.S. PATENT DOCUMENTS

| | | | | |
|---|---|---|---|---|
| 3,982,347 A * | 9/1976 | Brandl et al. | 42/84 |
| 4,298,914 A * | 11/1981 | Long | 362/112 |
| 4,329,908 A | 5/1982 | Rowlands | |
| 4,744,283 A | 5/1988 | Ibarra | |
| 5,062,323 A * | 11/1991 | Roberts et al. | 81/15.7 |
| 5,220,126 A | 6/1993 | Borgwarth et al. | |
| 5,229,539 A * | 7/1993 | Rommel | 89/27.14 |
| 5,303,495 A * | 4/1994 | Harthcock | 42/84 |
| 5,901,488 A * | 5/1999 | Oberlin | 42/84 |
| 6,397,508 B1 * | 6/2002 | Constant et al. | 42/84 |

* cited by examiner

*Primary Examiner*—Michelle R. Clement
(74) *Attorney, Agent, or Firm*—Oliff & Berridge, PLC

(57) ABSTRACT

A device to provide an electrical connection between a power generator integral with a weapon and a first contact area integral with a piece of ammunition, said device comprising a conductive rod carried by a breech of the weapon and able to translate with respect to said breech in order to come into contact with said first contact area of said ammunition, said rod incorporating a pointed end ensuring the deformation of said area wherein said rod has a rack onto which meshes a pinion integral with said breech, said pinion being driven in rotation by drive means actuated when said breech is closed.

8 Claims, 8 Drawing Sheets

DEVICE PROVIDING AN ELECTRICAL CONNECTION BETWEEN A WEAPON AND A PIECE OF AMMUNITION

BACKGROUND OF THE INVENTION

1. Field of Invention

The technical scope of the invention is that of devices providing an electrical connection between a power generator integral with a weapon and a first contact area integral with a piece of ammunition.

2. Description of Related Art

A device providing such an electrical connection is known by patent U.S. Pat. No. 5,220,126. This device comprises an axial contact that is mobile with respect to a breechblock and that penetrates in a deformable contact area integral with the ammunition. This axial contact is displaced by a hydraulic jack, thereby avoiding any contact rebound.

This device allows substantial electrical energy to be carried (in the form of impulsions of around a few hundred kilo Joules and up to one mega Joule). Such a level of energy is implemented today in weapon systems using plasma igniters.

However, this device suffers from certain drawbacks.

The hydraulic jack is cumbersome and consumes energy.

Moreover, the device proposed by this patent does not describe the means ensuring the return of the current from the ammunition to the generator. Whereas the quality of the return contact must be of a level at least equivalent to that of the outward contact.

SUMMARY OF THE INVENTION

The aim of the invention is to propose an electrical connection device that overcomes such drawbacks.

Thus, the device according to the invention reliably ensures the electrical connection between the weapon and the Ammunition but is of reduced bulk. The device according to the invention uses little energy whilst providing a reliable contact with no rebound.

The device according to the invention allows the flow of substantial energy (of around several hundred kilo Joules)

Thus, the invention relates to a device providing an electrical connection between a power generator integral with a weapon and a first contact area integral with a piece of ammunition, such device comprising a conductive rod carried by a breech of the weapon and able to translate with respect to said breech in order to come into contact with the first contact area of the ammunition, said rod incorporating a pointed end ensuring the deformation of said area, such device wherein the rod has a rack onto which meshes a pinion integral with the breech, said pinion being driven in rotation by drive means actuated when the breech is closed.

According to a particular embodiment, when the device according to the invention is applied to a weapon whose breech comprises a breechblock able to translate along a direction substantially perpendicular to an axis of the gun barrel, such breechblock driven in its displacement by a pivoting drive lever, the device is characterized in that the drive means comprise a cam integral with a pin carrying the pinion, such cam cooperating with a finger carried by the drive lever driving the device.

The cam may comprise a notch inside which the finger on the drive lever is housed, said finger locking the cam in its pivoted position corresponding to the establishment of a contact.

The rod may be pushed into its starting position, corresponding to the opening of the contact, by a return spring.

The rod may be surrounded by an insulating sheath of a length such that its front end delimits a chamber in which the point of the rod is housed.

The breech may incorporate a frontal surface onto which a conductive crown will be fixed that is intended to cooperate with a second ring-shaped contact area integral with an ammunition.

The conductive crown will advantageously be made of a tungsten alloy.

BRIEF DESCRIPTION OF THE DRAWINGS

The invention will be made more apparent by the following description of a particular embodiment, such description being made in reference to the appended drawings, in which.

DETAILED DESCRIPTION OF PREFERRED EMBODIMENT

Figure 1:
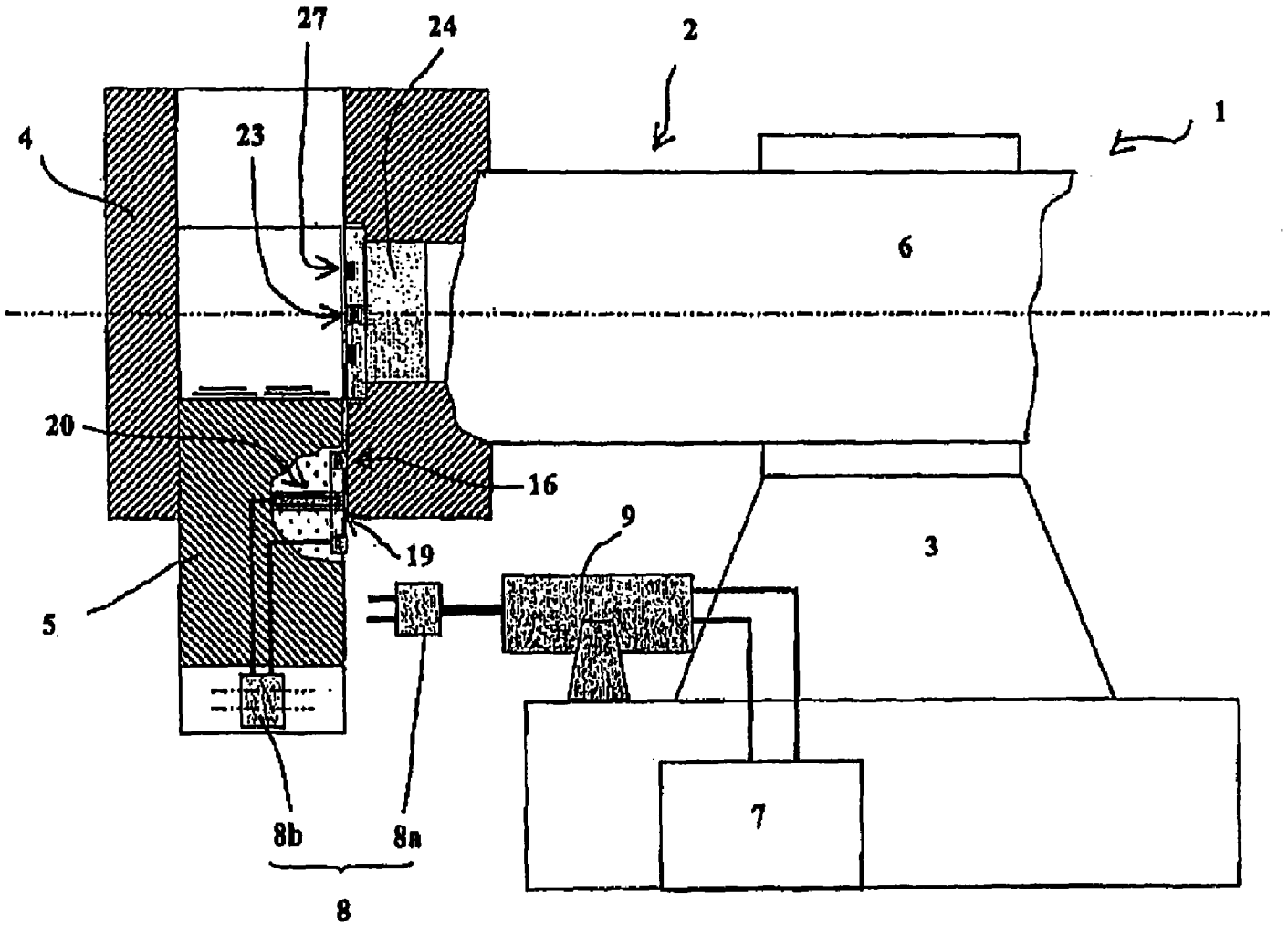
FIG. 1 is a schematic partial view of a weapon fitted with a device according to the invention.

With reference to FIG. 1, a weapon 1 incorporates a recoiling assembly 2 mounted able to slide with respect to a cradle 3. The recoiling assembly 2 comprises a barrel 6 that is equipped at its rear part with a breech sleeve 4, inside which a breechblock 5 moves (in the open position here). Such a weapon structure is well known to a man skilled in the art and requires no further description.

An electrical generator 7 is integral with the cradle 3 and is connected to the breechblock 5 by means of a connector 8 comprising a plug 8*a* integral with the cradle and a socket 8*b* integral with the breechblock.

In the open position of the breechblock shown here, the plug and socket are disconnected.

The plug 8*a* integral with the cradle is fastened to motor means 9, here constituted by a hydraulic jack whose body is integral with the cradle 3 of the weapon and whose rod carries the plug 8*a*.

By controlling the jack 9, it is possible for the plug 8*a* to be displaced so as to bring up the breechblock, then once the breechblock is closed, to bring the plug towards the socket to ensure the connection.

Moreover, since the socket 8*b* being integral with the recoiling assembly 2, the recoil of the assembly during firing causes a relative displacement of the socket with respect to the plug, and thus its disconnection.

Figure 2A:
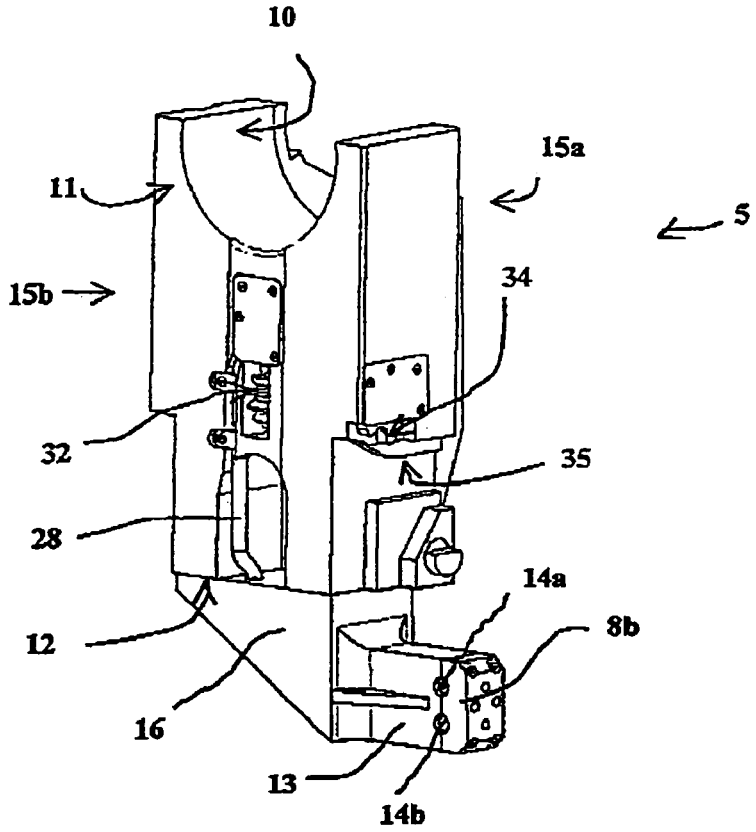
FIGS. 2*a* and 2*b* are perspective views of the breechblock alone according to two different orientations.
Figure 2B:
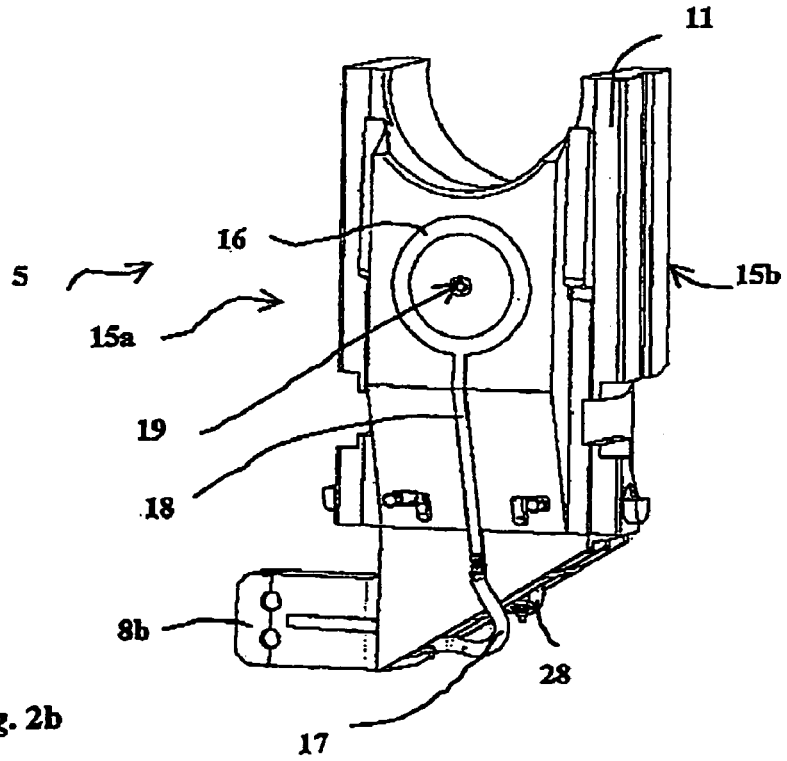

FIGS. 2*a* and 2*b* show the structure of the breechblock in greater detail. In a known manner, the breechblock 5 has a substantially parallelepipedal shape delimited at one of its ends by a hemi-cylindrical surface 10. Said surface is positioned opposite a lip of the weapon chamber when the breechblock 5 is open so as to allow a piece of ammunition to be placed into the chamber On its lateral faces 15*a*, 15*b*, the breechblock 5 has guiding surfaces 11 that cooperate with matching surfaces on the breech sleeve 4. The socket 8*b* is fixed on a lower face 12 of the breechblock. The socket 8*b* comprises an arm 13 provided with orifices 14*a*, 14*b* intended to accommodate the pins of the plug. Orifices 14*a* and 14*b* enclose conductive terminals (not shown) that cooperate with the pins of the plug to ensure electrical contact. The arm 13 is integral with a support 16 forming a bracket and fastened to the breechblock 5.

Figure 4:
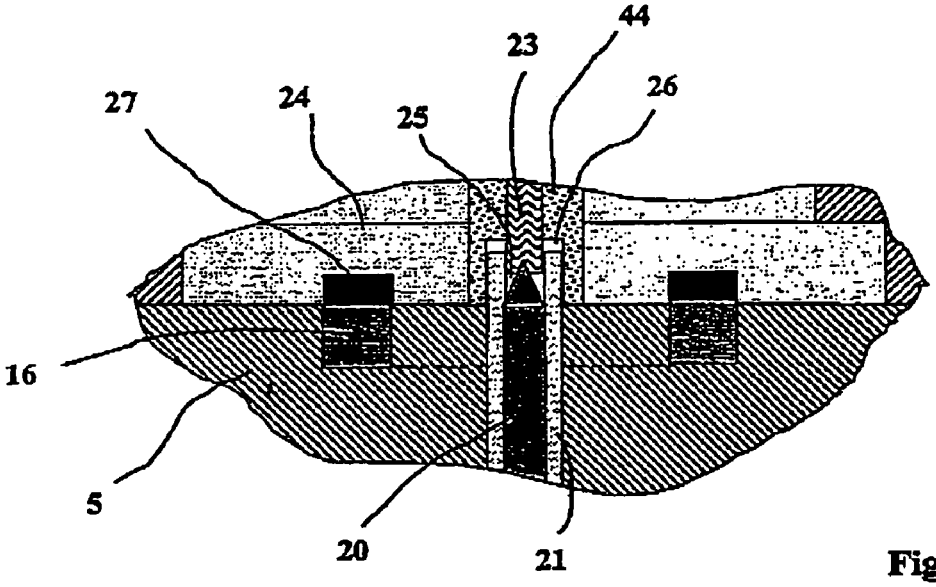
FIG. 4 is a partial view showing the electrical contacts made between the breechblock and an ammunition base.

As may be seen more clearly in FIG. 2*b*, the breechblock 5 has a conductive crown 16 on its face intended to obstruct the weapon chamber that is crimped into a ring-shaped groove in the breechblock 5 and which is intended to cooperate with a ring-shaped contact area 27 integral with the base 24 of a piece of ammunition (see FIG. 4). Reference may also be made to patent FR2824898, which describes in detail an ammunition base provided with a ring-shaped contact on its rear face and thus intended to cooperate with the crown 16 of the breechblock 5.

Advantageously, the conductive crown 16 will be made of a tungsten alloy. The mechanical strength of this crown is thus ensured for many firings. The ring-shaped contact 27 on the base 24 will, however, be made of a metal or alloy that is of greater malleability than tungsten and is very conductive, for example copper.

When the breechblock 5 is closed, the tungsten crown 16 will rub against the copper ring-shaped contact 27 thereby ensuring a good electrical contact without deteriorating the crown 16.

The crown 16 is electrically connected to one of the terminals of the socket 8*b* by a cable 17, connected to a conductive rod 18 integral with the breechblock 5.

In accordance with the invention, the breechblock 5 also has an axial contactor 19 on the axis of the crown 16. This contactor can be seen more particularly in FIGS. 3, 4, 5 and 6. It comprises a conductive rod 20 surrounded by an insulating sheath 21.

Rod 20 and sheath 21 are able to translate in a borehole 22 made in the breechblock 5.

The rod 20 incorporates a point 20*a* intended to ensure the deformation of an axial contact area 23 on the base 24 of a piece of ammunition (see FIG. 4). The insulating sheath 21 is of a length such that its front end delimits a chamber 25 in which the point 20*a* of the rod is housed. The sheath 21 is thus housed in a cylindrical cavity 26 in an insulating tube 44 integral with the base and surrounding the axial contact area 23. The electrical insulation between the rod 20 and thus crown 16 is thus improved when the ammunition is ignited.

Figure 3:
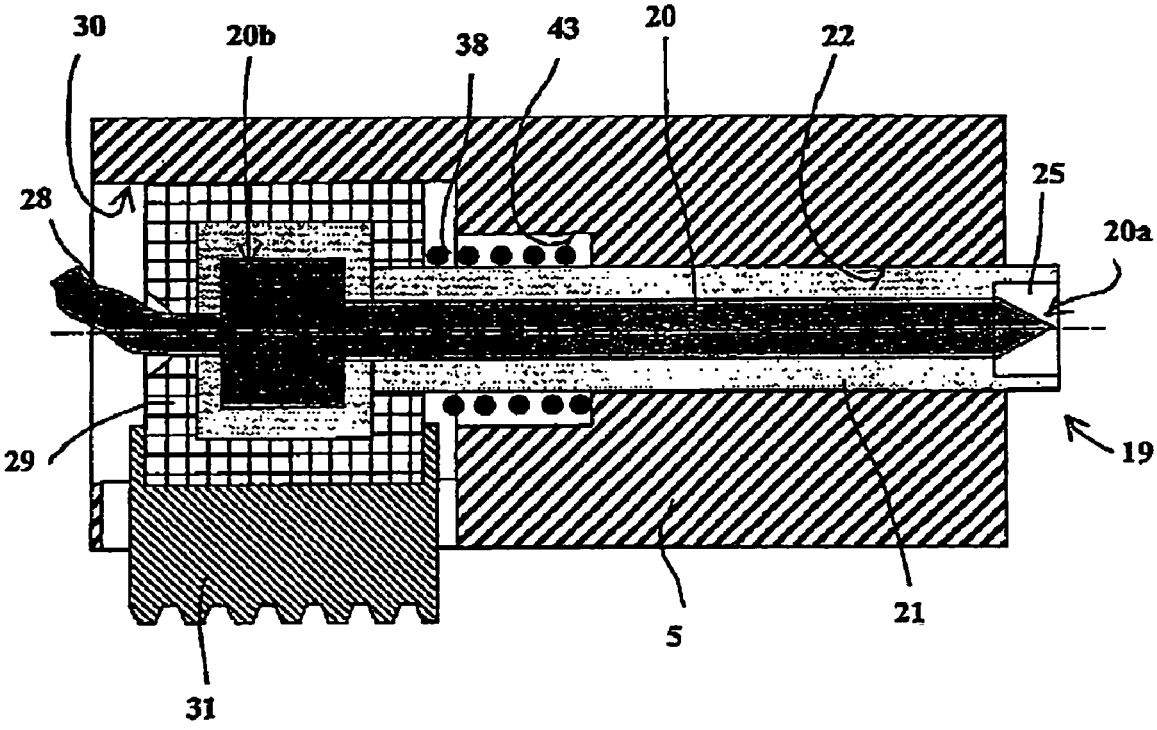
FIG. 3 is a section view of the contact rod and its assembly.
Figure 5:
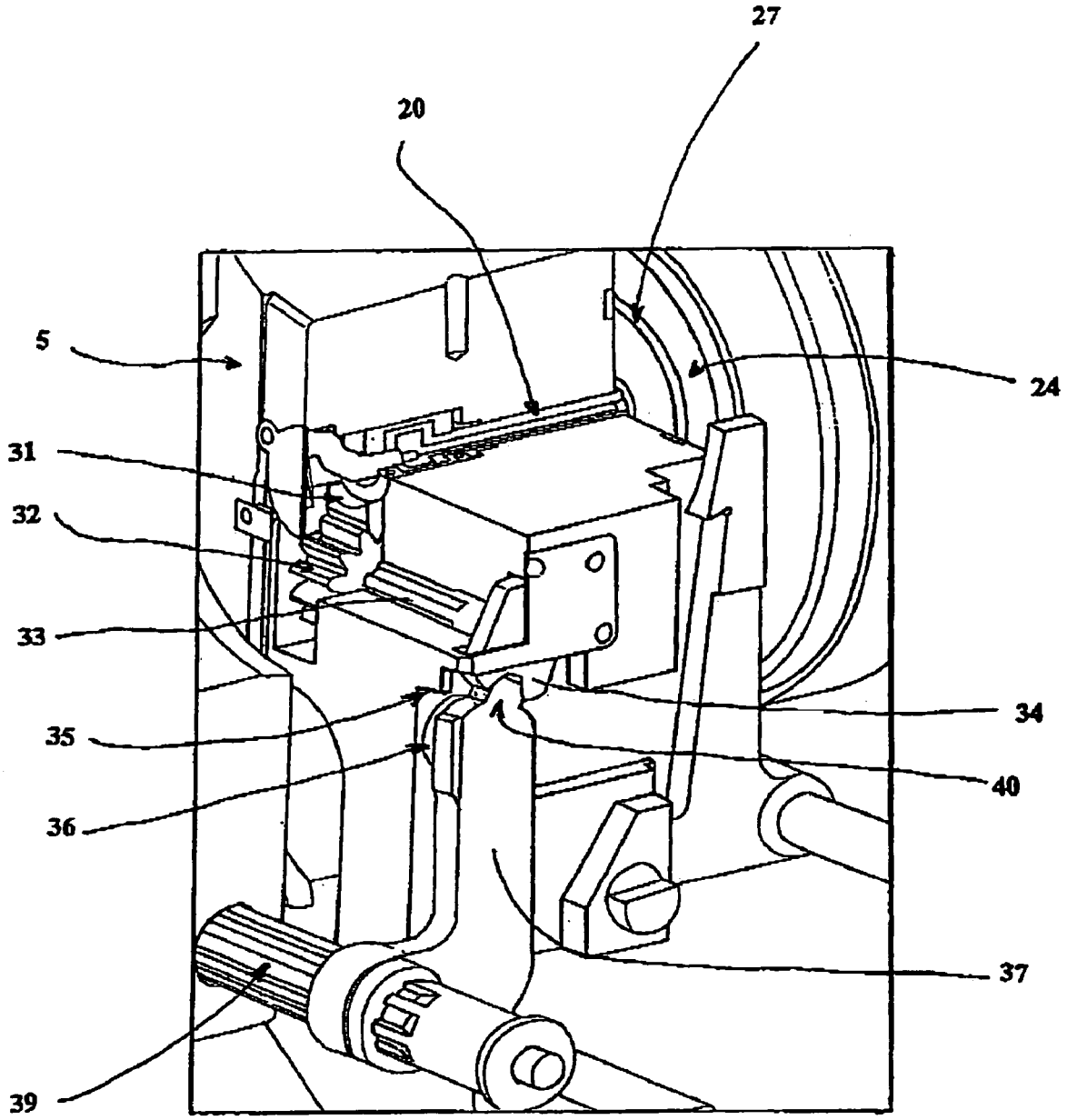
FIG. 5 is an exploded view of the weapon and the breechblock showing the connection device according to the invention as well as its drive means.
Figure 6:
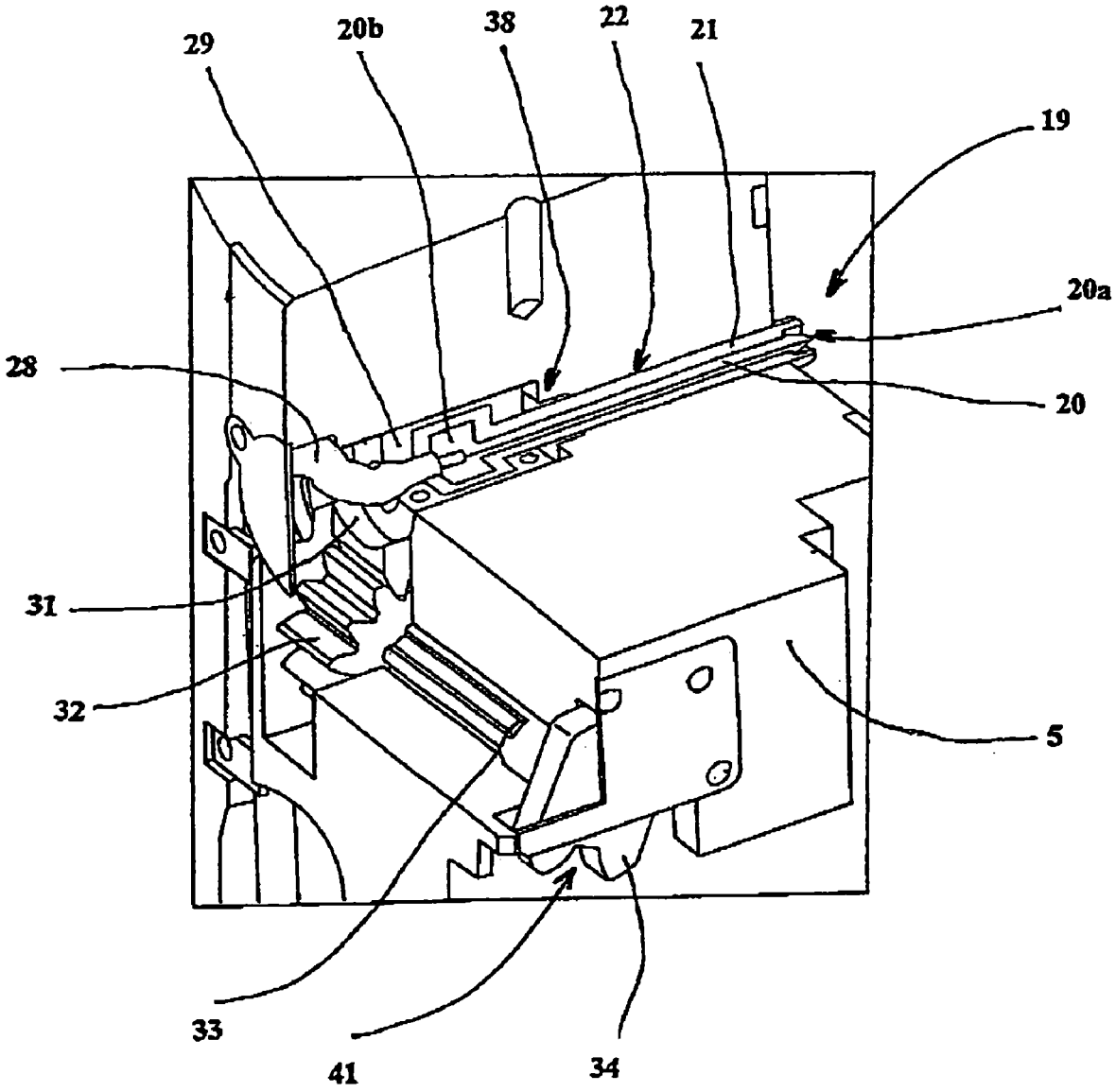
FIG. 6 is an enlarged exploded view of the breechblock showing the drive means.

As may be seen more particularly in FIGS. 3 and 6, the rod 20 incorporates an enlarged rear part 20*b* onto which an electrical cable 26 is fastened by welding and connected to a terminal of the socket 8*b*. The rear part 20*b* of the rod is also surrounded by the insulating sheath 21 and is fastened to a cylinder 29 made of an insulating material and mounted able to slide in an enlarged borehole 30, coaxial to borehole 22 accommodating the rod. A compression spring 38 is placed in a borehole 43 connecting borehole 30 and borehole 22. This spring is placed between the cylinder 29 and a facing connecting borehole 43 to borehole 22. This return spring 38 allows the rod 20 to be brought back into its starting position at a distance from the ammunition base.

The cylinder 29 has a rack 31 (fastened, for example, by screws) onto which a pinion 32 is meshed (see FIGS. 6 and 5) that is integral with a pin 33 substantially perpendicular to borehole 30. The other end of the pin 33 has a cam 34 placed on the lateral face 15*a* of the breechblock 5.

Moreover, in a known manner (and already described by patent FR2624961) the lateral face 15*a* of the breechblock has a profile 35 (see FIGS. 2*a*, 5, 7*b*) on which a roller 36, integral with a pivoting drive lever 37 (see FIG. 5), moves.

Figure 7A:
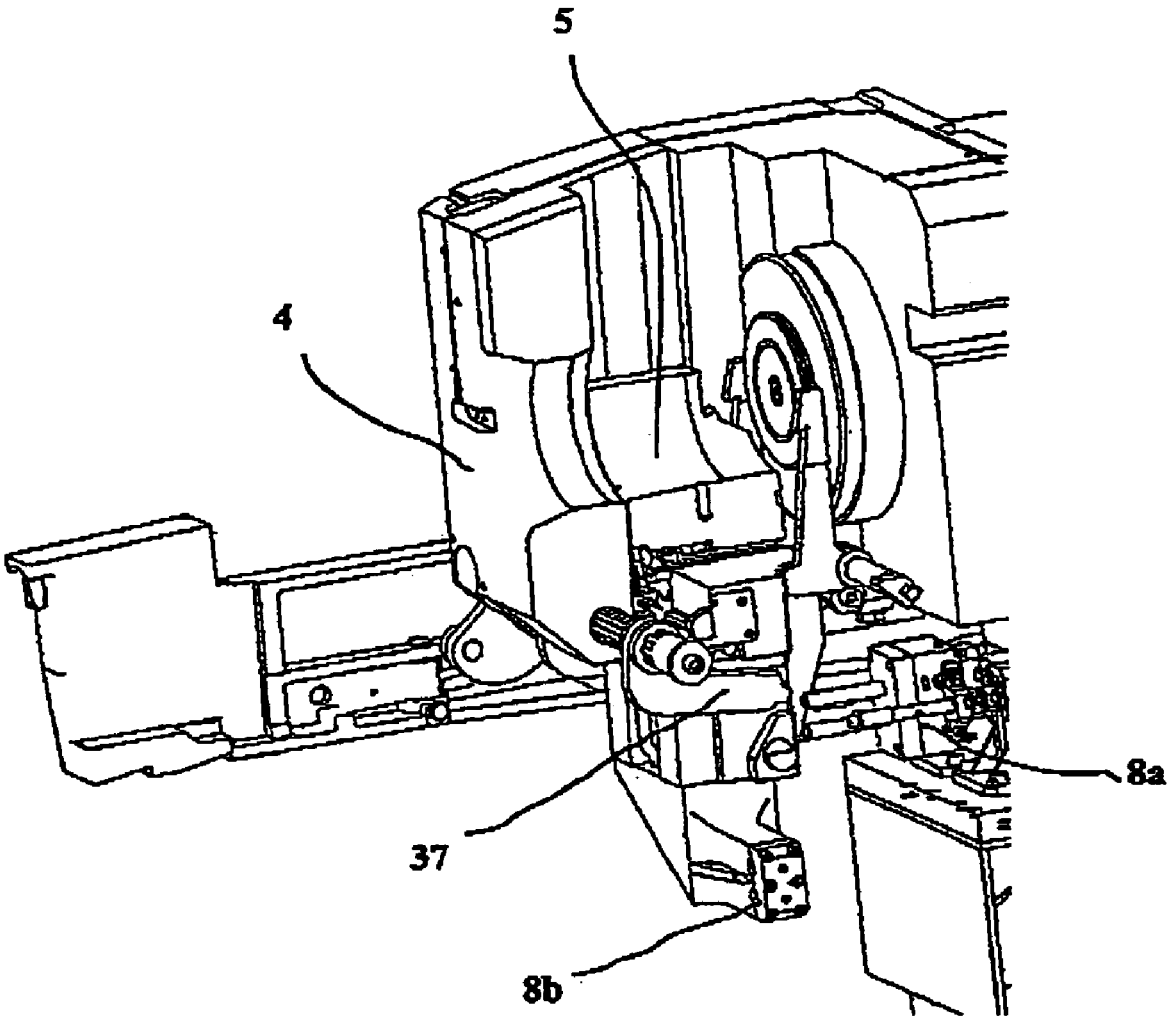
FIGS. 7*a*, 7*b* and 7*c* show three successive stages in the closing of the gun breech.
Figure 7B:
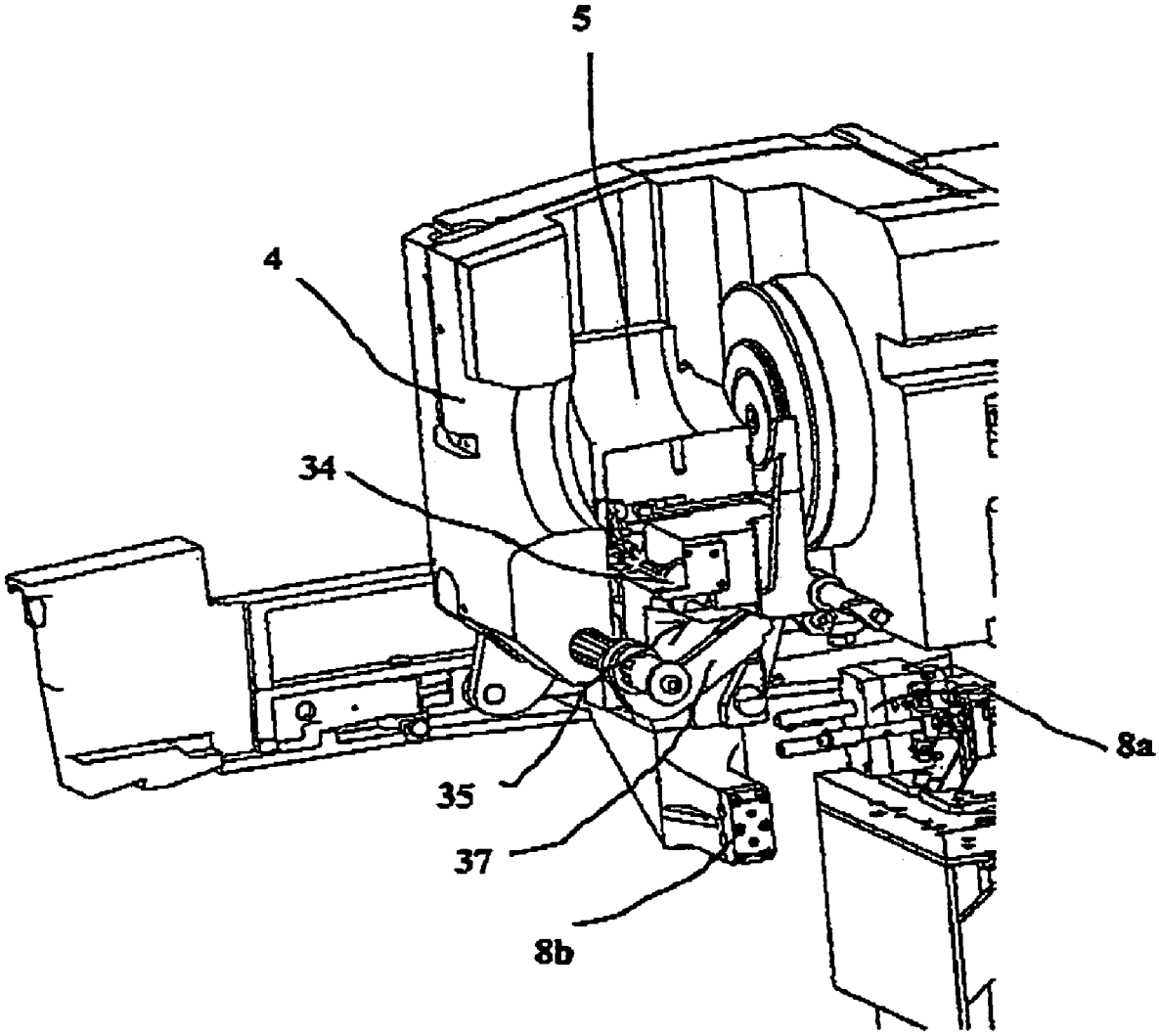

The drive lever 37 is driven in rotation by a grooved shaft 39 itself driven in rotation by a hydraulic motor (not shown). When the breechblock needs to be closed, the lever 37 is made to pivot anti-clockwise. The roller rolls on profile 35 of the breechblock and the lever thus pushes the breechblock 5 upwards so as to close the breech. Reference may be made to FIG. 7*a*, which shows the breechblock in the open position, and FIG. 7*b*, which shows the breechblock being closed.

In accordance with the invention, the drive lever 37 has a finger 40 at its end that is intended to cooperate with a notch 41 in the cam 34.

Figure 7C:
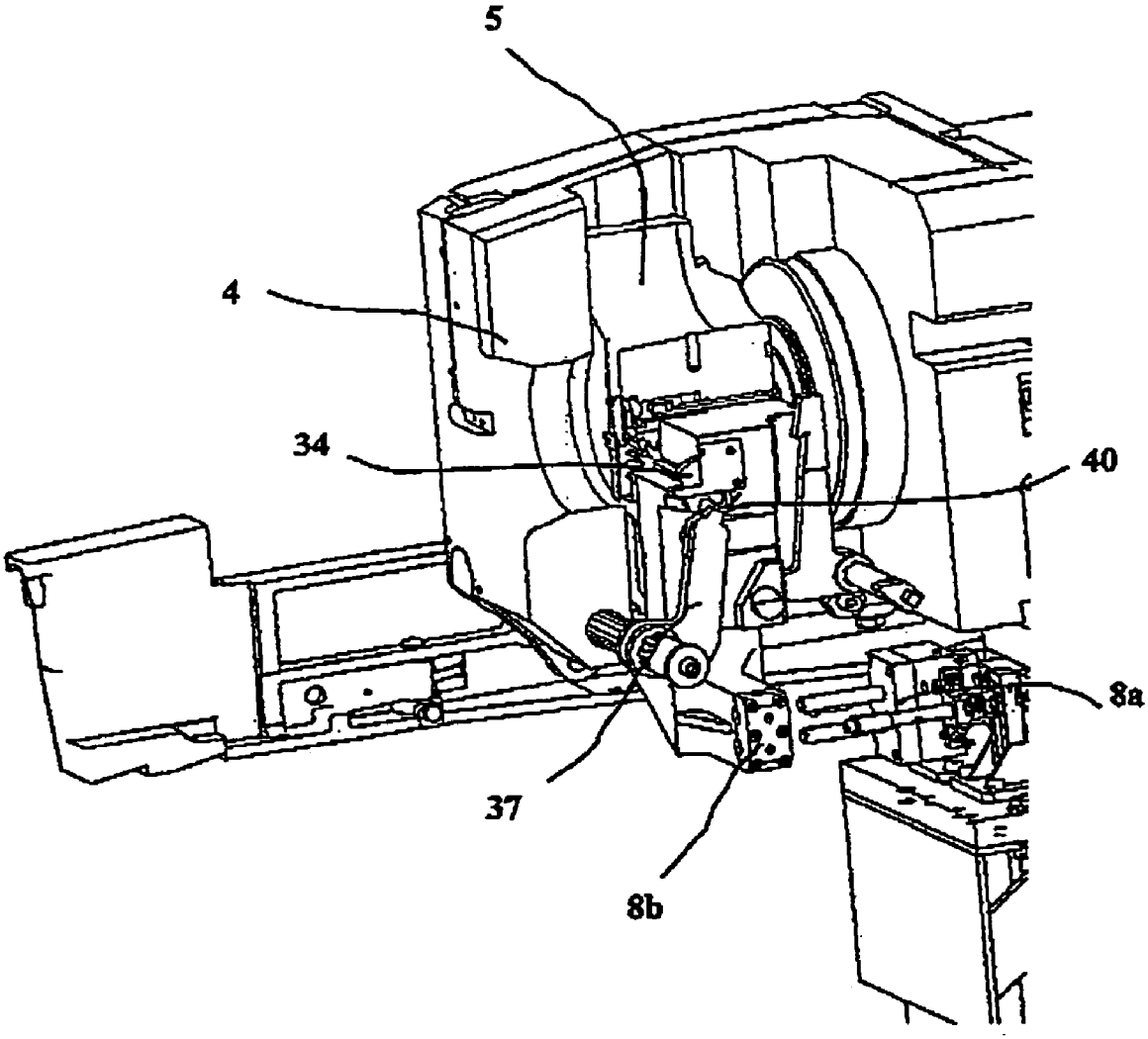

This cooperation only occurs when the lever 37 is in its substantially vertical position, that is to say, at the end of its stroke when closing the breechblock 5 (FIG. 7*c*).

At this instant, the breechblock 5 is in its closing position. The crown 16 is in contact with the ring-shaped contact 27 of the ammunition base and the rod 20 lies opposite the axial contact 23 of the base. The lever 37 continues to pivot a few degrees more thereby driving the cam 34. This, via the pinion 32, pushes the contact rod 20 towards the ammunition base so as to engage the point 20*a* of the rod in the axial contact area 23 of the base.

The lever 37 remains in this position until the breechblock is opened. The finger 41 thus locks the cam 34 in its pivoted position thereby allowing the contact rod 20 to be held engaged in the contact area 23 of the base without any risk of rebound. An electrical contact is thereby ensured that is both reliable and of excellent quality, allowing the flow of a high energy current (several hundred kilo Joules)

When the lever 37 is actuated to open the weapon breech (clockwise rotation), the finger 40 makes the cam 34 pivot in the opposite direction, thereby disengaging the contact rod 20 from the ammunition base. The return spring 38 assists in this disengagement and ensures that the rod is held in its retracted position inside the breechblock 5. Thus, the cam 34 is correctly oriented so as to be able to receive the finger 40 of the lever 37. It may be actuated once again by the finger 40 during another closing movement.

It is naturally possible for the invention to be adapted to another type of weapon, for example a weapon with a screw. breech. In this case, the closing movement of the screw (angular pivoting) may be used to cause the pinion driving the contact rod to pivot.

What is claimed is:

1. A device providing an electrical connection between a power generator integral with a weapon and a first contact area integral with a piece of ammunition, such device comprising an electrically conductive rod carried by a breech of said weapon and able to translate with respect to said breech in order to come into contact with said first contact area of said ammunition for the electrical connection, said rod incorporating a pointed end ensuring the deformation of said area, wherein said rod has a rack onto which meshes a pinion integral with said breech, said pinion being driven in rotation by drive means actuated by closing of said breech.

2. A device according to claim 1 and applied to a weapon whose breech comprises a breechblock able to translate along a direction substantially perpendicular to an axis of the gun barrel, such breechblock driven in its displacement by a pivoting drive lever, wherein said drive means comprises a cam integral with a pin carrying said pinion, such cam cooperating with a finger carried by said drive lever driving the device.

3. A device according to claim 2, wherein said cam comprises a notch inside which said finger of said drive lever is housed, said finger locking said cam in its pivoted position corresponding to the establishment of a contact.

4. A device according to claim 3, wherein said cam comprises a notch inside which said finger of said drive lever is housed, said finger locking said cam in its pivoted position corresponding to the establishment of a contact.

5. A device according to claim 1, wherein said rod is surrounded by an insulating sheath of a length such that its front end delimits a chamber in which said pointed end of said rod is housed.

6. A device according to claim 1, wherein said breech incorporates a frontal surface onto which a conductive crown is fixed that electrically cooperates with a second ring-shaped contact area integral with said ammunition.

7. A device according to claim 6, wherein said conductive crown is made of a tungsten alloy.

8. A device according to claim 1, wherein the rod includes a cylinder made of an insulating material, the cylinder connecting the rack with the rod.

* * * * *